US006597112B1

(12) United States Patent
Sillmon

(10) Patent No.: US 6,597,112 B1
(45) Date of Patent: Jul. 22, 2003

(54) PHOTOCATHODE FOR NIGHT VISION IMAGE INTENSIFIER AND METHOD OF MANUFACTURE

(75) Inventor: Roger S. Sillmon, McLean, VA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 246 days.

(21) Appl. No.: 09/635,671

(22) Filed: Aug. 10, 2000

(51) Int. Cl.[7] ..... H01J 40/06
(52) U.S. Cl. ..... 313/542; 313/544
(58) Field of Search ..... 313/541, 542, 313/543, 544, 530, 532

(56) References Cited

U.S. PATENT DOCUMENTS 3,862,859 A * 1/1975 Ettenberg et al. ..... 117/105
3,959,037 A * 5/1976 Gutierrez et al. ..... 148/33.5
3,960,620 A * 6/1976 Ettenberg ..... 117/90
3,972,750 A * 8/1976 Gutierrez et al. .. 148/DIG. 120
4,616,248 A * 10/1986 Khan et al. ..... 257/11
4,687,922 A * 8/1987 Lemonier et al. ..... 250/214 VT
5,084,780 A 1/1992 Phillips ..... 359/350
5,587,621 A * 12/1996 Colditz ..... 313/366
5,744,375 A * 4/1998 Kao et al. ..... 438/508
5,834,791 A * 11/1998 Nakanishi et al. ..... 250/423 P
5,932,966 A * 8/1999 Schneider et al. ..... 313/530
5,994,824 A 11/1999 Thomas et al. ..... 313/105 CM
6,121,612 A * 9/2000 Sinor et al. ..... 250/214 VT

* cited by examiner

*Primary Examiner*—Ashok Patel
*Assistant Examiner*—Glenn Zimmerman
(74) *Attorney, Agent, or Firm*—McDermott, Will & Emery

(57) ABSTRACT

A method of manufacturing a photocathode includes forming a seed layer with a single crystal structure on a faceplate; forming a window layer over the seed layer; and forming an active layer over the window layer. The method can also include the step of cleaning the faceplate before the seed layer is formed. The steps of cleaning the faceplate, forming the seed layer, forming the window layer and forming the active layer are performed in an organometallic chemical vapor deposition reactor system. The seed layer is formed by depositing a buffer layer on the faceplate and annealing the buffer layer to form the seed layer having. The atmosphere during the annealing of the buffer layer includes hydrogen, arsine, trimethylaluminum, and trimethylgallium. A photocathode formed from the method is also disclosed.

8 Claims, 5 Drawing Sheets

PHOTOCATHODE FOR NIGHT VISION IMAGE INTENSIFIER AND METHOD OF MANUFACTURE

FIELD OF THE INVENTION

The present invention relates to the manufacturing of image intensifier devices, and more particularly, to a process of manufacturing a photocathode.

BACKGROUND OF THE INVENTION

Image intensifiers, also known as a night vision systems, multiply the amount of incident light received by the image intensifier to provide a visible image. These devices typically require some low-level residual light, such as moon or star light, in which to operate. However, the present generation of image intensifiers can also make visible the light from the near-infrared (invisible) portion of the light spectrum. As used herein, the term "light" means electromagnetic radiation, regardless of whether or not this light is visible to the human eye. The image intensification process involves conversion of the received ambient light into electron patterns and projection of the electron patterns onto a phosphor screen for conversion of the electron patterns into light visible to the observer. This visible light can then be viewed directly by the operator or through a lens provided in the eyepiece of the system.

Image intensifiers are constructed for a variety of applications and therefore vary in both shape and size, with proximity focused image intensifiers comprising a particular type of image intensifier having the smallest size and weight of all categories of image intensifiers. These devices are particularly useful for both industrial and military applications. For example, image intensifiers are used in night vision goggles for enhancing the night vision of aviators and other military personnel performing covert operations. They are also employed in security cameras, photographing astronomical bodies and in medical instruments to help alleviate conditions such as retinitis pigmentosis, more commonly known as night blindness. Such an image intensifier device is exemplified by U.S. Pat. No. 5,084,780, entitled TELESCOPIC SIGHT FOR DAY/NIGHT VIEWING by Earl N. Phillips issued on Jan. 28, 1992, and assigned to ITT Corporation the assignee herein.

Image intensifiers are currently manufactured in two types, commonly referred to as Generation II (GEN 2) and Generation III (GEN 3) type image intensifier tubes. The primary difference between these two types of image intensifier tubes is in the type of photocathode employed in each. Image intensifier tubes of the GEN 2 type have a multi-alkali photocathode with a spectral sensitivity in the range of 400–900 nanometers (nm). This spectral range can be extended to the blue or red by modification of the multi-alkali composition and/or thickness. GEN 3 image intensifier tubes have a p-doped gallium arsenide (GaAs) photocathode that has been activated to negative electron affinity by the adsorption of cesium and oxygen on the surface. This material has approximately twice the quantum efficiency of the GEN 2 photocathode. An extension of the spectral response to the near infrared can be accomplished by alloying indium with gallium arsenide. A third type of image intensifier is current being introduced and will be know as Generation IV (GEN 4) image intensifier. A GEN 4 image intensifier is similar to the GEN 3 except improvements have been made to the microchannel plate.

A GEN 3 image intensifier tube according to the prior art is illustrated in FIG. 1. The image intensifier tube 10 comprises an evacuated envelope or vacuum housing 22 having a photocathode 12 disposed at one end of the housing 22 and a phosphor-coated anode screen 30 disposed at the other end of the housing 22. A microchannel plate 24 is positioned within the vacuum housing 22 between the photocathode 12 and the phosphor screen 30. The photocathode 12 comprises a glass faceplate 14 coated on one side with an antireflection layer 16; a aluminum gallium arsenide ($Al_xGa_{1-x}As$) window layer 17; a gallium arsenide active layer 18; and a negative electron affinity coating 20.

The microchannel plate 24 is located within the vacuum housing 22 and is separated from the photocathode 12 by a gap 34. The microchannel plate 24 is generally made from a thin wafer of glass having an array of microscopic channel electron multipliers extending between input surfaces 26 and output surfaces 28. The wall of each channel is formed of a secondary emitting material. The phosphor screen 30 is located on a fiber optic element 31 and is separated from the output surface 28 of the microchannel plate 24 by a gap 36. The phosphor screen 30 generally includes an aluminum overcoat 32 to stop light reflecting from the phosphor screen 30 from reentering the device through the negative electron affinity coating 20.

In operation, photons from an external source impinge upon the photocathode 12 and are absorbed in the GaAs active layer 18, resulting in the generation of electron/hole pairs. The electrons generated by the photo cathode 12 are subsequently emitted into the gap 34 of the vacuum housing 22 from the negative electron affinity coating 20 on the GaAs active layer 18. The electrons emitted by the photo cathode 12 are accelerated toward the input surface 26 of the microchannel plate 24 by applying a potential applied across the input surface 26 of the microchannel plate 24 and the photo cathode 12 of approximately 800 volts.

When an electron enters one of the channels of the microchannel plate 24 at the input surface 26, a cascade of secondary electrons is produced from the channel wall by secondary emission. The cascade of secondary electrons are emitted from the channel at the output surface 28 of the microchannel plate 24 and are accelerated across gap 36 toward the phosphor screen 30 to produce an intensified image. Each microscopic channel functions as a secondary emission electron multiplier having an electron gain of approximately several hundred. The electron gain is primarily controlled by applying a potential difference across the input and output surfaces of the microchannel plate 24 of about 900 volts.

Electrons exiting the microchannel plate 24 are accelerated across the gap 36 toward the phosphor screen 30 by the potential difference applied between the output surface 28 of the microchannel plate 24 and the phosphor screen 30. This potential difference is approximately 6000 volts. As the exiting electrons impinge upon the phosphor screen 30, many photons are produced per electron. The photons create an intensified output image on the output surface of the optical inverter or fiber optics element 31.

A method of manufacturing a GEN 3 image intensifier photocathode according to the prior art is illustrated in FIGS. 2*a*–2*e*. In a series of steps, a buffer layer or layers 42 are grown on a single crystal substrate 40 and an etching stop layer 44 is provided over the buffer layer 42, as illustrated in FIG. 2*a*. These three layers 40, 42, 44 will be subsequently removed during the formation of the faceplate/photocathode structure, and the stop layer 44 facilitates the removal of the substrate 40 during a later processing step. The substrate 40 is typically formed from GaAs, and the stop layer 44 is typically formed from a different composition than the substrate 40, such as $Al_xGa_{1-x}As$.

As illustrated in FIG. 2*b*, a p-type conductivity GaAs active layer 18 is deposited on the $Al_xGa_{1-x}As$ stop layer 44. This is typically accomplished using organometallic chemical vapor deposition. After deposition of the active layer 18, an $Al_xGa_{1-x}As$ window layer 17 is deposited over the active layer 18, as illustrated in FIG. 2*c*. Additionally, an antireflective coating 16 can be formed over the window layer 17. This complete structure forms a photocathode wafer 12*a*.

As illustrated in FIG. 2*d*, the photocathode wafer 12*a* is bonded to a faceplate 14. This is typically accomplished by heating the photocathode wafer 12*a* and faceplate 14 to a temperature close to the softening point of the material of the faceplate 14. This heating is followed by application of pressure to the wafer 12*a* and faceplate 14 to bond the wafer 12*a* to the faceplate 14. After cooling, the wafer 12*a* is rigidly bonded to the faceplate 14. As illustrated in FIG. 2*e*, the substrate 40, buffer layer 42, and stop layer 44 are removed by chemical etching to form the photocathode 12/faceplate 14 structure.

Subsequent steps (not illustrated) include chemical or mechanical/chemical polishing to eliminate any exposed surfaces defects, such as scratches, formed during the previous processing steps. An electrical contact layer is then applied to the outer circumference of the active layer and onto the faceplate. The photocathode is then etched a final time to remove any remaining damage to the active layer. After etching, the finished photocathode/faceplate structure is coated with negative electron affinity coating and assembled into an image intensifier tube.

Many problems are associated with the use of the above-described method of manufacturing. A number of these problems are associated with the large number, as many as 25, of processing steps involved in this method. The large number of processing steps increases the probability that defects will be introduced into one of the processes resulting in substantial loss of photocathode components during manufacturing. Many losses are caused by defects introduced into the $GaAs/Al_xGa_{1-x}As$ material during the many processing steps. For example, scratches on the GaAs surface will result in poor image quality of the image intensifier.

Another problem is the use of the high-pressure thermal bonding process to attach the photocathode to the face place. This process subjects the photocathode to stress, which degrades the crystalline quality of the photocathode material. This degradation of the photocathode material can also degrade the image quality of the image intensifier and degrade the photoresponse characteristics of the image intensifier.

Still another problem associated with this method is that the GaAs substrate material has to be removed and disposed. Not only is the material cost of the GaAs substrate substantial, this material is not even used in the finished photocathode component. Furthermore, additional costs are incurred during the disposal of toxic waste caused by arsenic contaminated chemical etching byproducts. Accordingly, a need exists for an improved method of forming a photocathode for use in an image intensifier that reduces defects imparted during the method of manufacture and eliminates the requirement of a GaAs substrate.

SUMMARY OF THE INVENTION

This and other needs are met by embodiments of the present invention which provide a method of manufacturing a photocathode on a faceplate. The method comprises forming a seed layer with a single crystal structure on the faceplate; forming a window layer over the seed layer; and forming an active layer over the window layer.

By depositing a seed layer over the faceplate and depositing a window layer over the seed layer, the present invention advantageously reduces stress between the faceplate and the photocathode materials in the window layer and the active layer. Also, this method does not require the formation and later removal of a GaAs substrate material found in prior art methods, which allows savings in costs associated with the GaAs material, processing costs of forming the GaAs substrate, and disposal and processing costs associated with removing the GaAs substrate.

A further aspect of the present invention is to clean the faceplate before the seed layer is formed. The cleaning of the faceplate, the forming of the seed layer, the forming of the window layer and the forming the of active layer are preferably performed in an organometallic chemical vapor deposition reactor system. By performing these processes within the reactor system without having to remove the faceplate and photocathode from the reactor system, the handling of the photocathode is advantageously minimized. A reduction in handling leads to reduced losses because handling of the photocathode can create defects in the photocathode material.

Additional advantages of the present invention will become readily apparent to those skilled in this art from the following detailed description, wherein only the preferred embodiment of the present invention is shown and described, simply by way of illustration of the best mode contemplated for carrying out the present invention. As will be realized, the present invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWINGS

Reference is made to the attached drawings, wherein elements having the same reference numeral designations represent like elements throughout, and wherein.

DETAILED DESCRIPTION OF THE INVENTION

The present invention addresses and solves the problem of forming a photocathode structure of a window layer and an active layer without the need for a substrate layer that requires removal in subsequent processing steps. The present invention addresses and solves this problem by depositing a seed layer over a faceplate, and forming the window and active layers over the seed layer. Advantageously, by manufacturing the photocathode is this manner, the number of processing steps for forming a photocathode is reduced, the number of defects is reduced, and the costs associated with forming and removing the substrate layer are eliminated.

Figure 1:
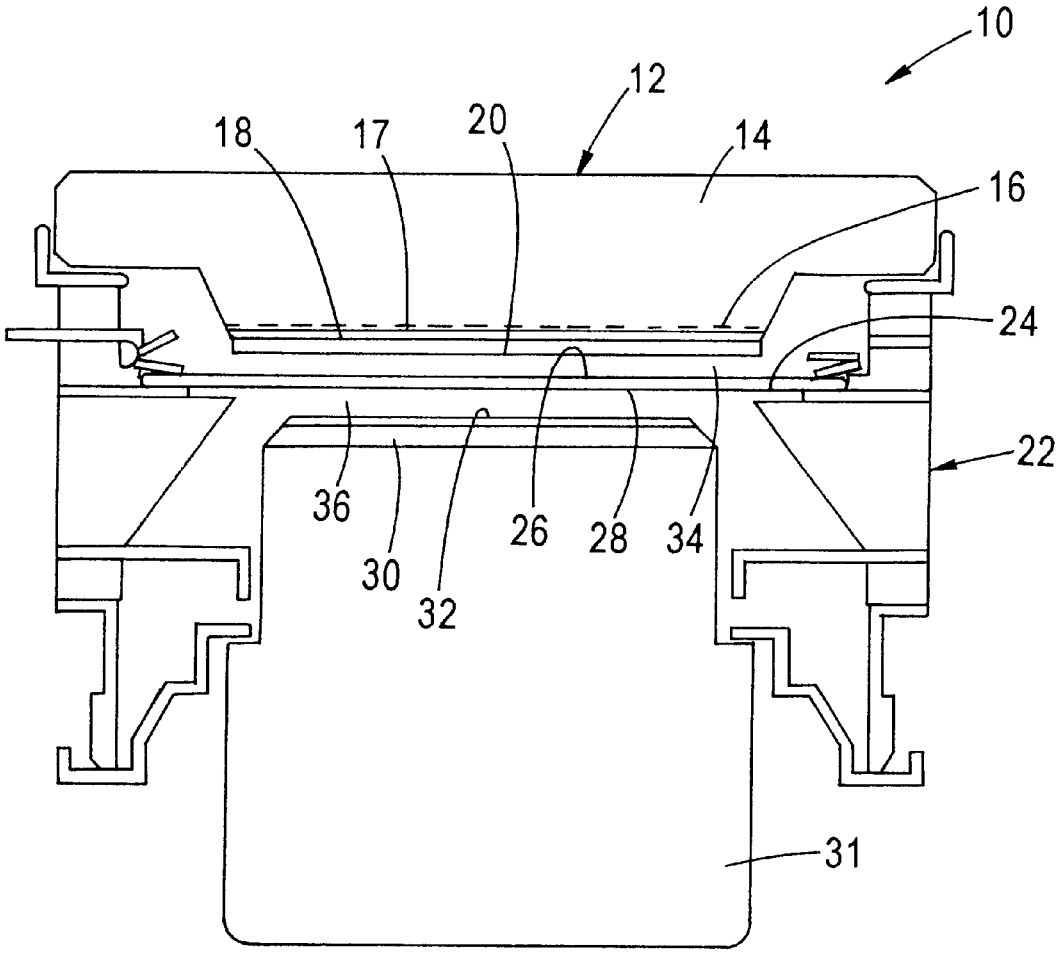
FIG. 1 (PRIOR ART)
FIG. 1 is a cross-sectional view of an image intensifier in accordance with the prior art.
Figure 2A:
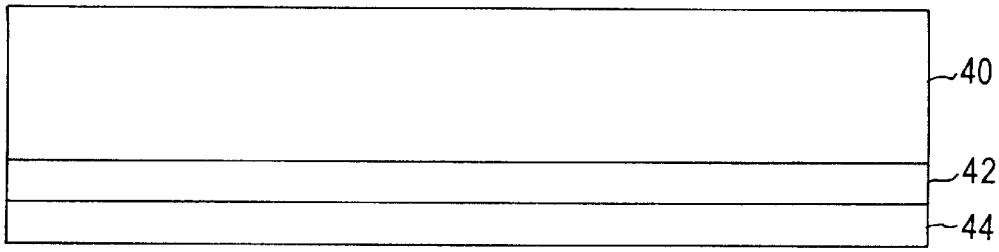
FIG. 2a (PRIOR ART)
FIGS. 2*a–e* schematically illustrate sequential phases of a method of forming a photocathode on a faceplate in accordance with the prior art.
Figure 2B:
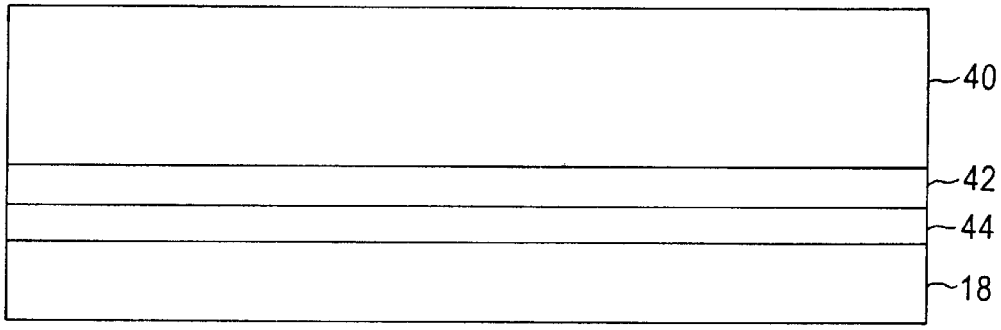
FIG. 2b (PRIOR ART)
Figure 2C:
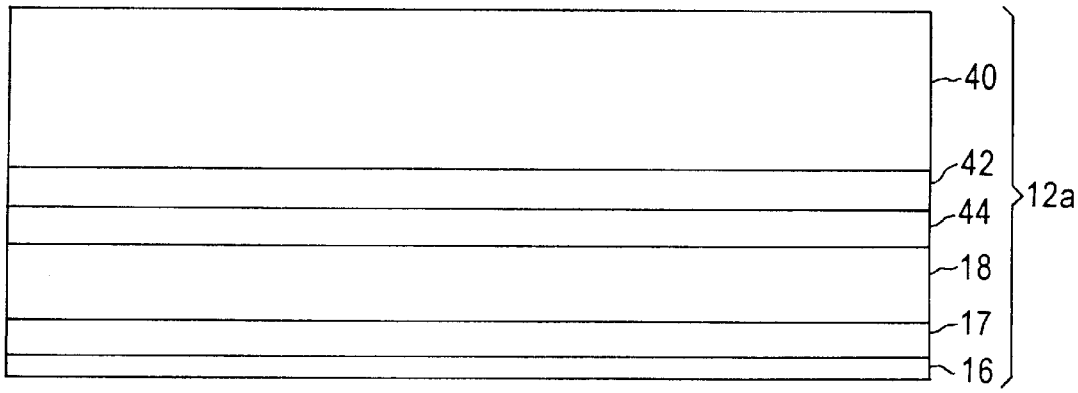
FIG. 2c (PRIOR ART)
Figure 2D:
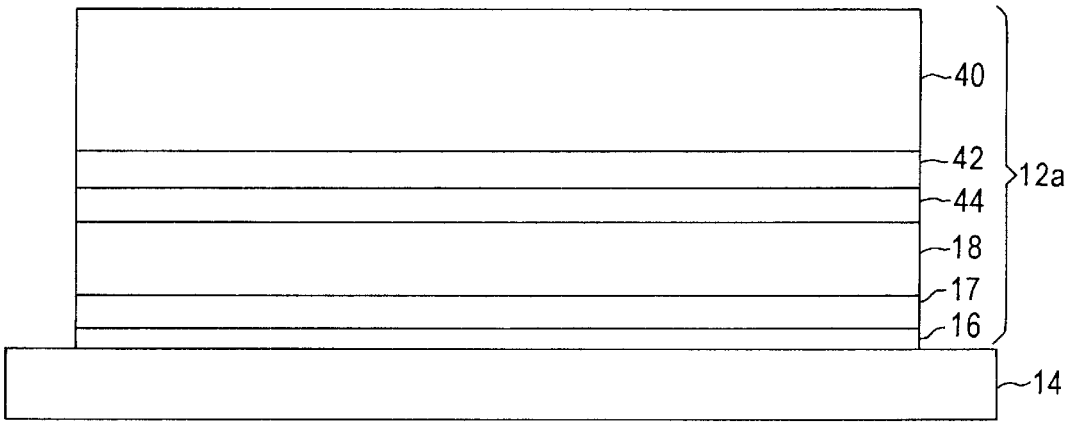
FIG. 2d (PRIOR ART)
Figure 2E:
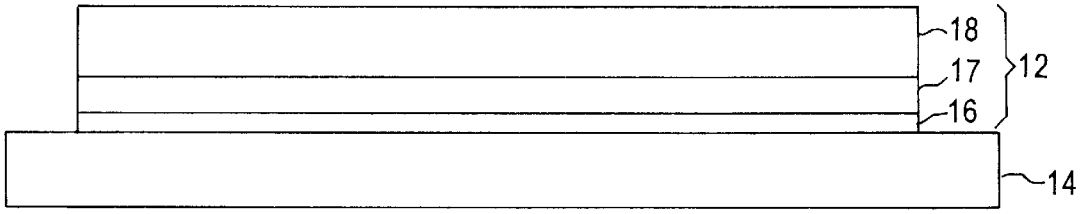
FIG. 2e (PRIOR ART)
Figure 3:
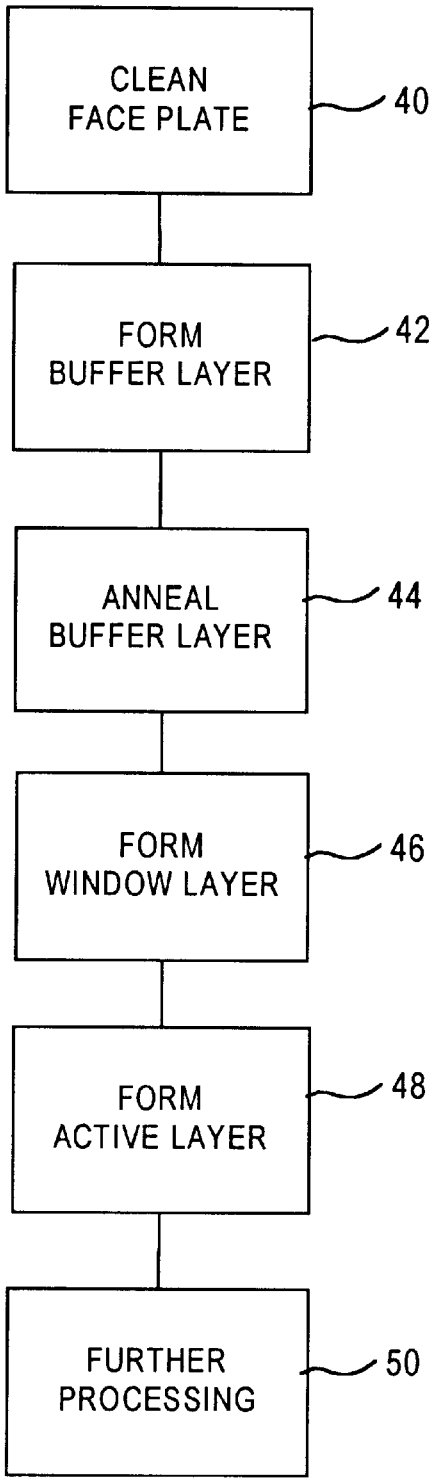
FIG. 3 is a flow chart of a method of forming a photocathode on a faceplate according to an embodiment of the present invention.

In accordance with embodiments of the present invention, a method of manufacturing a photocathode is illustrated in FIG. 3. After a faceplate is cleaned 40, a buffer layer is formed 42 on a surface of the faceplate. The buffer layer is then annealed 44 to form a seed layer. A window layer is subsequently formed 46 over the seed layer, and an active layer is formed 48 over the window layer to create the photocathode. After formation of the photocathode on the faceplate, the combined structure is assembled 50 into an image intensifier.

Figure 4A:
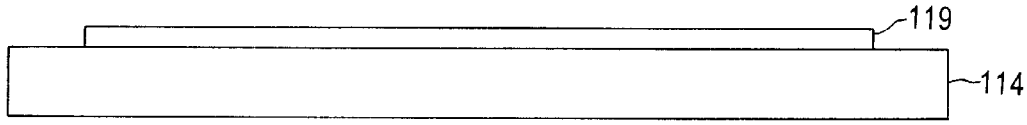
FIGS. 4*a–c* schematically illustrate sequential phases of a method of forming a photocathode on a faceplate according to an embodiment of the present invention.
Figure 4B:
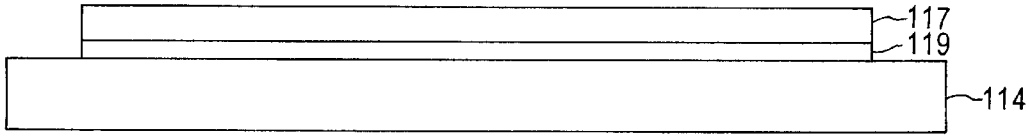
Figure 4C:
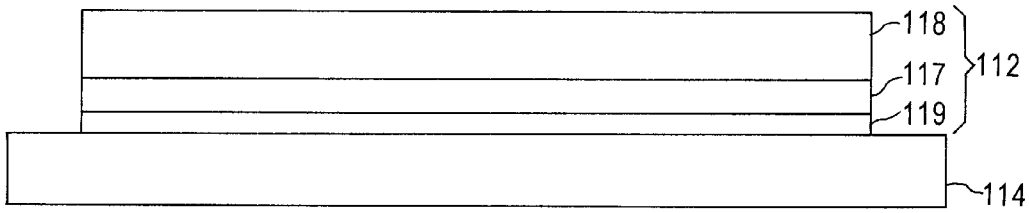

The manufacturing of a photocathode on a faceplate is further illustrated in FIGS. 4*a–c*, wherein sequential phases in forming a photocathode/faceplate structure in accordance with the present invention are depicted. Referring to FIG. 4*a*, a faceplate 114 is provided to transmit photons of light to the active regions of a photocathode. The faceplate 114 can be formed from any material capable of transmitting photons in the wavelength of length for which the photocathode will be used. The faceplate 114 should additionally be capable of being used as a template for single-crystal growth. Examples of acceptable materials for use as a faceplate 114 include silicon carbide. In a preferred embodiment, however, the faceplate is formed from single-crystal sapphire ($Al_2O_3$). This material is highly transparent to light in the ultraviolet wavelength band beyond 150 nm and up to the middle of the infrared wavelength band. Also, the sapphire can be provided with dimensions equal to the final dimensions of the faceplate 114 thereby allowing the faceplate 114 to be directly assembled into an image intensifier without modification.

Before a buffer layer 119 is grown over the faceplate 114, the faceplate 114 is preferably cleaned to remove contaminants, such as hydrocarbons. Any method of cleaning a faceplate 114 to remove contaminants is acceptable for use with this invention. Examples of cleaning methods include use of hydrogen plasma and reactive ion etch. However, in current embodiments of the invention, the faceplate 114 is loaded into an organometallic chemical vapor deposition reactor system and heated in a hydrogen and arsine gas atmosphere to above 450° C. to facilitate cleaning of the surface of the faceplate 114. In a presently preferred embodiment, the cleaning is performed at temperatures between about 650–1000° C.

After the faceplate 114 has been cleaned, one or more epitaxial buffer layers 119 are grown on the faceplate 114. The buffer layer 119 acts as a seed crystal surface for the growth of the remaining photocathode structure, and the buffer layer 119 can be formed from any material so capable. In current embodiments of the invention, however, the buffer layer 119 is formed from a material used to form the window layer 117. For example, in a presently preferred embodiment, in which the window layer 117 is formed from $Al_xGa_{1-x}As$, the buffer layer 119 is also formed from $Al_xGa_{1-x}As$. Additionally, the buffer layer 119 is preferably transparent to wavelengths of light for which the photocathode is intended to receive.

The buffer layer 119 is preferably formed on a surface of the faceplate 114 that is most appropriate for crystal growth. For example, when the faceplate 114 is formed from single-crystal sapphire. In current embodiments of the invention, the crystal orientation of the faceplate 114 is the C-axis ((0001) plane). Other crystal orientations of the surface are available upon which the buffer layers 119 can be formed, for example the R-axis. In a presently preferred embodiment, the thickness of the buffer layer 119 is from about 50 to 500 angstroms.

Any method of forming a buffer layer 119 capable of acting as a seed crystal surface for the growth of the remaining photocathode structure is acceptable for use with this invention. For example, molecular beam epitaxy can be used to deposit the buffer layer 119. In current embodiments of the invention, in which the faceplate 114 is cleaned using the organometallic chemical vapor deposition reactor system, the faceplate 114 preferably remains in the reactor system. The temperature of the reactor system is then lowered to a temperature of about 500–600° C. in a hydrogen and arsine atmosphere to prepare the faceplate 114 for growth of the buffer layer 119.

The buffer layer 119 of $Al_xGa_{1-x}As$ is then deposited on the faceplate 114 using the reactor system. During deposition, a vapor source of aluminum and a vapor source of gallium is introduced into the reactor system. Although any vapor source of aluminum and a vapor source of gallium is acceptable for use with this invention, the preferred vapor source of aluminum is trimethylaluminum and the preferred vapor source of gallium is trimethylgallium.

After the buffer layer 119 of $Al_xGa_{1-x}As$ has been deposited on the faceplate 114, the buffer layer 119 is annealed to form a high quality single-crystal seed layer 119. The quality of the crystal is determined by the number of defects in a layer, and a high number of defects can reduce the optical-electronic properties of the layer. This layer can act as an intermediate nucleation layer for formation of additional layers.

In current embodiments of the invention, the faceplate 114 remains in the reactor system, and the temperature within the reactor system is increased to above 650° C. in an annealing atmosphere. Although any annealing atmosphere is acceptable for use with this invention, the annealing atmosphere preferably includes hydrogen, trimethylaluminum, trimethylgallium and arsine.

As illustrated in FIG. 4*b*, after the formation of the seed layer 119, a window layer 117 is formed over the seed layer 119. The window layer acts as a structural transition between the faceplate 11 4/buffer layer 119 and the crystalline structure of the active layer 118 (best shown in FIG. 4*c*). The window layer 117 is also preferably highly transparent to the light of the desired spectral range for the photocathode and improves the photoresponse characteristics of the photocathode. Many materials known by those skilled in art are capable of being used for a window layer 117, and this invention is not limited as to a particular material. However, in a preferred embodiment, the window layer 117 is formed from $Al_xGa_{1-x}As$.

In current embodiments of the invention, after the buffer layer is annealed to form the seed layer 119, the faceplate 114 remains in the reactor system and trimethylaluminum, trimethylgallium and arsine are introduced into the reactor system. The window layer 117 of $Al_xGa_{1-x}As$ is then deposited over the seed layer 119. Additionally, in a preferred embodiment in which. the photocathode is used for a GEN 3 or GEN 4 image intensifier, the window layer 117 is doped to create a p-type structure. Although any p-type dopant is acceptable for use with this invention, the window layer 117 is preferably doped with a vapor source of zinc, such as diethylzinc.

After the formation of the window layer 117, an active layer 118 is formed over the window layer 117, as illustrated in FIG. 4*c*. The active layer 118 is photoemissive such that the material of the active layer 118 absorbs light of the desired spectral range. The photo-generated carriers diffuse to a negative electron affinity coating and then are emitted into a vacuum envelope across a gap, thereby generating a photocurrent. Many type III–V semiconductor materials, such as GaP, GaInAsP and InAsP exhibit a photoemissive effect. However, in a preferred embodiment, the active layer 118 is formed from GaAs.

In current embodiments of the invention, after the window layer 117 of $Al_xGa_{1-x}As$ is deposited over the seed layer 119 in the reactor system, the faceplate 114 remains in the reactor system and the active layer 118 of GaAs is deposited over the window layer 117 to form the photocathode 112. The active layer 118 is also doped to create a p-type structure in a similar manner as the window layer 117.

The process of depositing a seed layer 119 on the faceplate 114 and then depositing a window layer 117 over the seed layer 119 is particularly advantageous. As previously discussed, prior art methods of attaching the window layer 117 to the faceplate 114 involve a high-pressure thermal bonding of the window layer 117 to the faceplate 114. This process of high-pressure thermal bonding creates stress and degrades the crystalline quality of the photocathode materials in the window layer 117 and the active layer 118. This degradation causes a reduced image quality of the image intensifier 110 and decreased photoresponse characteristics. Stress can also be introduced between the faceplate 114 and the window layer 117 and active layer 118 when the faceplate 114 is formed from a material, such as $Al_2O_3$, having a dissimilar coefficient of thermal expansion and a different crystal lattice than the window material of layer 117, such as $Al_xGa_{1-x}As$, and the active layer 118, such as GaAs. However, the method of attaching the window layer 117 to the faceplate 114 with the use of a seed/buffer layer 119 according to the present invention, in contrast to prior art methods, advantageously reduces stress between the faceplate 114 and the photocathode materials in the window layer 117 and the active layer 118. One manner in which this stress is reduced is the elimination of the high-pressure thermal bonding process. Also, the seed/buffer layer 119 acts as a buffer to reduce stress defects from propagating into the photocathode materials in the window layer 117 and the active layer 118.

Another particular advantage of the present invention is that a GaAs substrate material does not have to be removed and disposed, in contrast to the prior art methods. Thus, the present invention saves costs associated with forming the GaAs substrate and disposal costs associated with removal of the GaAs substrate.

As discussed above, in current embodiments of the invention, the photocathode 112 is formed by placing the faceplate 114 in an organometallic chemical vapor deposition reactor system, cleaning the faceplate 114, depositing at least one buffer layer 119 on the faceplate 114, annealing the buffer layer 119 to form a seed layer 119, depositing a window layer 117 over the seed layer 119, and depositing an active layer 118 over the window layer 117. These processes are all preferably performed without removing the faceplate 114 and photocathode 112 from the reactor system. In so doing, handling of the faceplate 114 and photocathode 112 during the formation of the photocathode 112 is advantageously minimized. This reduction in handling substantially reduces defects caused by handling of the photocathode 112.

The intensifier tube 110 can also include an antireflective coating (not shown) on the faceplate 114. The antireflective coating prevents ambient light from reflecting off of the faceplate 114, and any antireflective coating so capable is acceptable for use with this invention. An example of an antireflective coating is silicon nitride. However, in a preferred embodiment, the antireflective coating is formed from $MgF_2$.

The invention is not limited as to when the antireflective coating is applied to the faceplate 114. For example, the antireflective coating can be applied prior to or after the deposition of the photocathode materials. In current embodiments of the invention, however, the antireflective coating is applied to the outer surface of the faceplate 114 after the formation of the window layer 117 and active layer 118.

Upon completion, the faceplate 114 and photocathode 112 structure can be used in the assembly of an image intensifier device 110. The assembly of such an imagine intensifier device 110 is exemplified by U.S. Patent No. 5,994,824, entitled LIGHT WEIGHT/SMALL IMAGE INTENSIFIER TUBE to Thomas et al., and is incorporated herein by reference.

EXAMPLE 1

A single-crystal sapphire faceplate is loaded into an organometallic chemical vapor deposition reactor system and the reactor system is heated to a temperature between 650–1000° C. in an atmosphere of hydrogen and arsine gas to clean the surface of the sapphire faceplate. After the sapphire faceplate has been cleaned, the temperature within the reactor system is lowered to between 500–600° C. to facilitate growth of a buffer layer of $Al_xGa_{1-x}As$. At low concentrations, approximately $5\times10^{-5}$ mole/mole of $H_2$ for each, trimethylaluminum and trimethylgallium are introduced into the reactor system to deposit a 50 to 500 angstrom thick buffer layer of $Al_xGa_{1-x}As$.

After the buffer layer of $Al_xGa_{1-x}As$ has been deposited on the faceplate, the temperature within the reactor system is increased to above 650° C. in an annealing atmosphere to anneal the buffer layer to form a high quality single crystalline seed layer. After the buffer layer has been annealed to form the seed layer, trimethylaluminum, trimethylgallium and arsine are introduced into the reactor system to grow an $Al_xGa_{1-x}As$ window layer and a GaAs active layer. The window and active layers are then doped with zinc to form a p-type doped structures using diethylzinc as a vapor source of zinc.

After the window and active layers are grown over the sapphire faceplate, an antireflective coating of $MgF_2$ is applied to the outer surface of the sapphire faceplate. The finished photocathode structure is then processed to apply a negative electron affinity coating and assembled into an image intensifier tube using ultra high vacuum processing and assembly techniques.

The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without resorting to the details specifically set forth. In other instances, well known processing structures have not been described in detail, in order not to unnecessarily obscure the present invention.

Only the preferred embodiment of the present invention and but a few examples of its versatility are shown and described in the present disclosure. It is to be understood that the present invention is capable of use in various other combinations and environments and is capable of changes or modifications within the scope of the inventive concept as expressed herein.

What is claimed is:

1. A photocathode, comprising:

a faceplate;

an annealed seed layer on and contacting said faceplate;

window layer over said annealed seed layer; and an active layer over said window layer.

2. A photocathode according to claim 1, wherein said seed layer is single-crystalline.

3. A photocathode, comprising:

a faceplate;

an annealed seed layer on and contacting said faceplate, said seed layer formed from a composition including $Al_xGa_{1-x}As$;

a window layer over said annealed seed layer, said window layer formed from a composition including $Al_xGa_{1-x}As$; and an active layer over said window layer, said active layer formed from a composition including GaAs.

4. A photocathode according to claim 1, wherein said seed layer is formed from a composition including $Al_xGa_{1-x}As$.

5. A photocathode according to claim 1, wherein said seed layer is formed from a composition including GaAs.

6. A photocathode according to claim 1, wherein said seed layer is formed from a sapphire.

7. A photocathode, comprising:

a faceplate;

a seed layer on said faceplate;

a window layer over said seed layer; and an active layer over said window layer, wherein said seed layer is formed on a surface of said faceplate, said surface having a surface orientation of a C-axis (0001) plane.

8. A photocathode according to claim 3, wherein a thickness of said seed layer is between about 50 to 500 angstroms.

* * * * *

UNITED STATES PATENT AND TRADEMARK OFFICE

CERTIFICATE OF CORRECTION

PATENT NO. : 6,597,112 B1
DATED : July 22, 2003
INVENTOR(S) : Roger S. Sillmon

It is certified that error appears in the above-identified patent and that said Letters Patent is hereby corrected as shown below:

Column 10,
Lines 7-8, change "A photocathode according to claim 1, wherein said seed layer is formed from a sapphire" to -- A photocathode according to claim 1, wherein said faceplate is formed from sapphire --.

Signed and Sealed this

Twentieth Day of July, 2004

JON W. DUDAS
*Acting Director of the United States Patent and Trademark Office*